US005518126A

United States Patent [19]

Davis

[11] Patent Number: 5,518,126

[45] Date of Patent: May 21, 1996

[54] PLASTICWARE RETAINER FOR USE IN AN AUTOMATIC DISHWASHER

[75] Inventor: Randy Davis, Kinston, N.C.

[73] Assignee: White Consolidated Industries, Inc., Cleveland, Ohio

[21] Appl. No.: 283,281

[22] Filed: Jul. 29, 1994

[51] Int. Cl.[6] ..... A47F 5/00

[52] U.S. Cl. ..... 211/41; 248/499

[58] Field of Search ..... 211/41; 248/499; 160/24, 370.2 A; 134/201, 135

[56] References Cited

U.S. PATENT DOCUMENTS

| | | | |
|---|---|---|---|
| 3,612,285 | 10/1971 | Mason . | |
| 3,752,322 | 8/1973 | Fiocca et al. . | |
| 3,934,728 | 12/1976 | Guth . | |
| 3,935,958 | 2/1976 | Frangos . | |
| 4,058,233 | 11/1977 | Frangos . | |
| 4,498,594 | 2/1985 | Elder | 211/41 X |
| 4,732,291 | 3/1988 | McConnell . | |
| 4,748,993 | 6/1988 | Llewellyn . | |
| 4,830,200 | 5/1989 | Zambano et al. . | |
| 4,832,206 | 5/1989 | Cunningham . | |
| 4,917,248 | 4/1990 | Friskney . | |
| 5,114,019 | 5/1992 | Sandbank . | |
| 5,121,843 | 6/1992 | Elder . | |
| 5,201,826 | 4/1993 | Zimmermann . | |
| 5,205,419 | 4/1993 | Purtilo . | |
| 5,211,191 | 5/1993 | Brown . | |
| 5,344,029 | 9/1994 | Oghia et al. | 211/41 |

*Primary Examiner*—Robert W. Gibson

*Attorney, Agent, or Firm*—Pearne, Gordon, McCoy & Granger

[57] ABSTRACT

A plasticware retainer is provided for holding lightweight articles in a dishwasher rack to prevent them from dislodging during a washing cycle. The retainer includes a net member, a roller assembly, and connectors. A first end of the net member is attached to the roller assembly which removably attaches to the dishwasher rack. The connectors are attached to a second end of the net member to attach the second end of the net member to the rack when the net member is in an extended position over the dishwasher rack to prevent the lightweight articles from dislodging during washing. The net member is retracted into the roller assembly in a window shade fashion to remove the articles in the dishwasher rack and or storage of the plasticware retainer.

14 Claims, 3 Drawing Sheets

11
13
34
26
25
24
20
34
22
17
15
19
29
23
12
18
27
21
14
10
16

PLASTICWARE RETAINER FOR USE IN AN AUTOMATIC DISHWASHER

BACKGROUND OF THE INVENTION

FIELD OF THE INVENTION

The present invention generally relates to automatic dishwashers, and more specifically, to a retainer for preventing movement of lightweight articles in an upper rack of a dishwasher.

DESCRIPTION OF RELATED ART

A dishwasher generally has upper and lower racks which are slidably mounted to tracks fixed to inner sides of the dishwasher. The racks are pulled out for easy loading of dishes. Cups, glasses, and other containers are normally placed upside down along the racks for washing so that they will not fill with water. When the racks are loaded with dishes, the racks are pushed back into the dishwasher, the door is closed, and the washing cycle is initiated.

During the washing cycle, high pressure streams of water are upwardly projected against the dishes in the racks. In many cases, the force of the projecting water is strong enough to dislodge lightweight articles such as plastic cups. If dislodged to a right-side up position, the lightweight article fills with water. The weight of the water prevents the right-side up article from dislodging again to the upside down position to dump the water. The water therefore, remains in the article for the entire wash cycle and prevents the inside of the article from being properly cleaned. When the rack is pulled out and the dishes unloaded, the unclean water can spill out of the right-side up article onto clean dishes in the lower rack below.

An additional problem with unrestrained dishes in an automatic dishwasher is the melting of plastic articles. Lightweight plastic articles are frequently dislodged by the force of the projecting water and come to rest near a heating element. The heating element melts or reshapes the plastic articles to render them unusable.

Means for retaining articles in a dishwasher rack during washing are known in the prior art. For example, U.S. Pat. No. 3,935,958 discloses an enclosure for washing eating utensils in a dishwasher. The enclosure is provided with compartments for holding the utensils and hinged rigid covers for closing the compartments. A handle is provided to lift the enclosure from a horizontal loading position outside the dishwasher to an upright washing position in the dishwasher. See also U.S. Pat. No. 4,058,233 for a related utensil enclosure for a dishwasher having a rigid lid. U.S. Pat. Nos. 4,830,200, 4,748,993, and 4,732,291 also disclose enclosures, having pivotally mounted rigid covers, specifically for holding baby bottle parts in a dishwasher. U.S. patent application Ser. No. 08/179,486 discloses a retainer having a plurality of rigid panels pivotally interconnected to conform to and overlie the articles in the dishwasher rack.

U.S. Pat. Nos. 5,201,826 discloses a restraining net for securing articles in a dishwasher. The net includes a rectangular flexible mesh member of a dimension generally corresponding to the periphery of the dishwasher rack and an elastic flexible border member around the periphery of the mesh member. The border member is placed around the exterior of the rack to retain the mesh member in a position closing the rack.

U.S. Pat. No. 5,121,843 also discloses a restraining net for covering a dishwasher rack. The net is convex or dome-like in shape with a periphery corresponding to a dishwasher rack. The net has a central opening which provides an unobstructed passage through the net. Fasteners such as S-hooks are provided for fastening the periphery of the net around the periphery of the dishwasher rack. The fasteners have one end hooked in an aperture of the dishwasher rack and another end hooked in a loop of the net.

U.S. Pat. No. 5,114,019 discloses another restraining net for covering a dishwasher rack. The net includes a circular center portion of inelastic mesh, an annular band at the periphery of the center portion and of bidirectionally elastic open weave, and an elastic edge band at the periphery of the annular band. The edge band is placed around the exterior of the rack to retain the center and annular portions in a position closing the rack.

U.S. Pat. No. 4,832,206 discloses a net-like article holding device for dishwashers. The device includes a stretchable elongated rectangular mesh member and rigid connector bars at opposite ends of the mesh member. The connector bars are placed on the outside of the dishwasher rack across adjacent vertical support wires. The elasticity of the mesh member causes the mesh member to stretch across and exert a downward force onto the articles in the rack. One version of the device replaces one of the connector bars with a retractable roller. When the mesh is not required to be stretched across the articles it is rolled up on the roller.

Each of the aforementioned patents are incorporated herein in their entirety by reference.

It is desirable to provide an effective retainer for preventing movement of lightweight articles in an upper rack of a dishwasher during washing. It is further desirable to provide a retainer that is inexpensive, simple to construct, convenient to stow, accessible, not dependent on a special location or orientation of the articles to be cleaned, and compatible with a standard dishwasher rack.

SUMMARY OF THE INVENTION

The present invention provides a retainer that solves the problem of lightweight articles being dislodged from a dishwasher rack by a force of upwardly projecting washing liquid during washing. The disadvantages of the prior art are overcome by providing a retainer that is easily installed and removed and easily stored when not in use.

According to the invention, there is provided a roller having means for mounting to said dishwasher rack and a flexible inelastic generally rectangularly-shaped net member. A first end of the net member is attached to the roller, and means for attaching a second end of the net member to the dishwasher rack is provided. The net member extends over the dishwasher rack to retain the lightweight articles in the dishwasher rack during washing.

The retainer of the present invention is easily installed or removed because the net member is simply extended and retracted from the roller above the dishwasher rack. The retainer can be left on the dishwasher rack or easily removed from the dishwasher for storage when not in use. Furthermore, because the retainer can be used with a standard dishwasher rack and is not attached to the rack, it can be easily added to existing dishwashers or replaced if necessary.

BRIEF DESCRIPTION OF THE DRAWINGS

The present invention will hereafter be described with reference to the drawing figures, wherein.

DETAILED DESCRIPTION OF THE PREFERRED EMBODIMENTS

Figure 1:
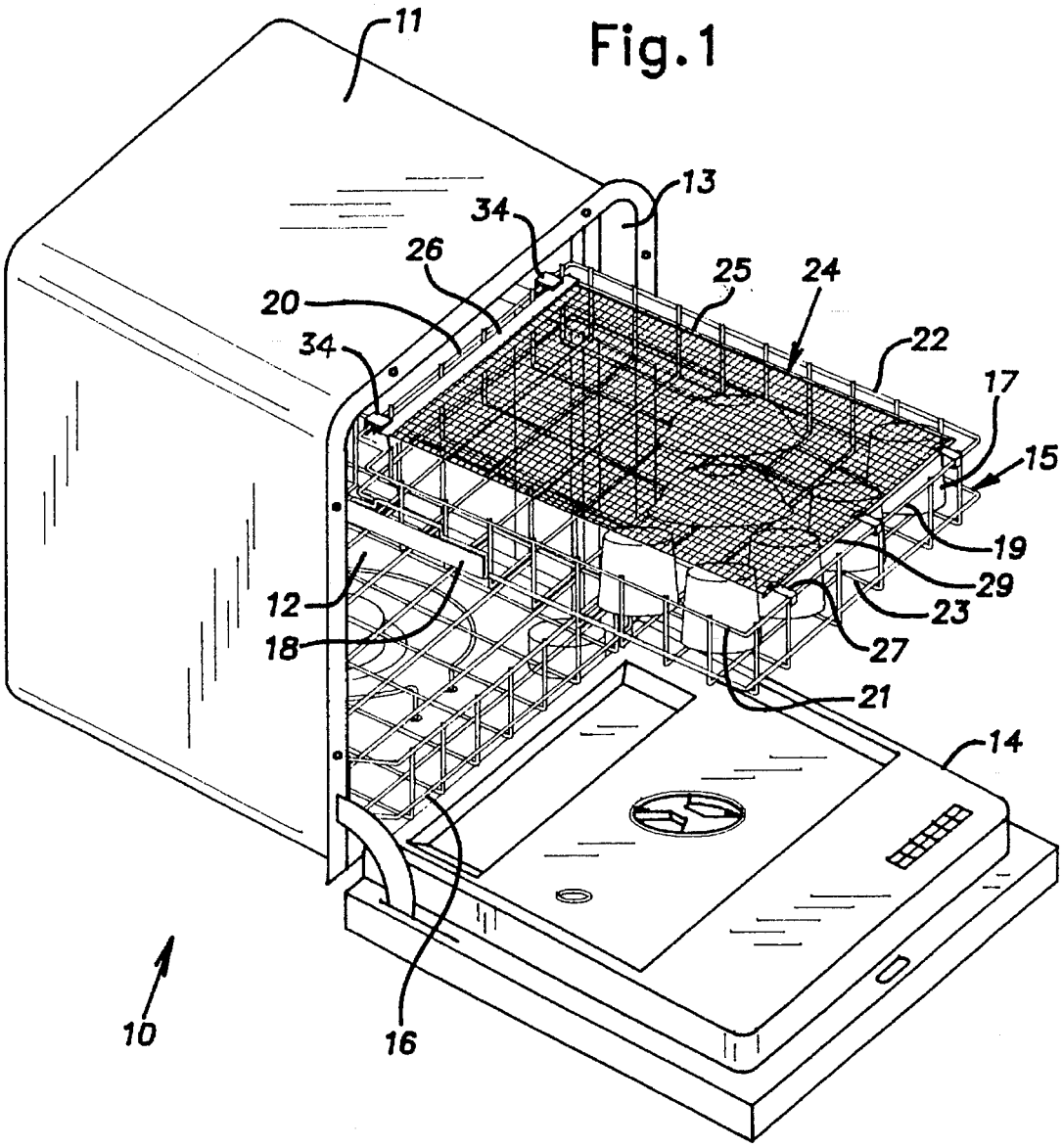
FIG. 1 is a perspective view of a dishwasher with a retainer according the present invention installed in the upper rack.

A front loading automatic dishwasher 10, shown in FIG. 1, includes a tub 11 defining a cleaning chamber 12 having a front opening 13. A door 14 is hingedly mounted at the bottom of the front opening 13 for pivotal movement about a bottom edge, as is conventional. The door 14 moves from a vertical closed position (not shown) to a horizontal open position (shown in FIG. 1). Supported within the chamber 12 are an upper rack 15 and a lower rack 16 for supporting soiled articles 17 for cleaning by the dishwasher 10.

The lower rack 16 is supported within the chamber 12 by suitable tracks and is adapted to be rolled out onto the door 14 in its open position for loading and unloading. The upper rack 15 is supported within the chamber by a pair of conventional telescopic tracks 18. The upper rack 15 is movable from a retracted position within the chamber 12 (not shown) and a fully extended position overlying the door 14 in its open position (shown in FIG. 1) for loading and unloading.

The racks 15, 16 are generally basket-shaped having a front 19, a back 20, opposed sides 21, 22 and a bottom 23. The racks 15, 16 are formed of segmental wire-frame construction wherein wire segments are spaced sufficiently closely to prevent stored articles 17 from passing therethrough, while exposing the articles 17 to an upwardly projecting washing liquid for cleaning. Preferably, the front 19, back 20, and sides 21, 22 include vertically and horizontally extending wire segments, and the bottom 23 includes transversely and longitudinally extending wire segments.

Figure 2:
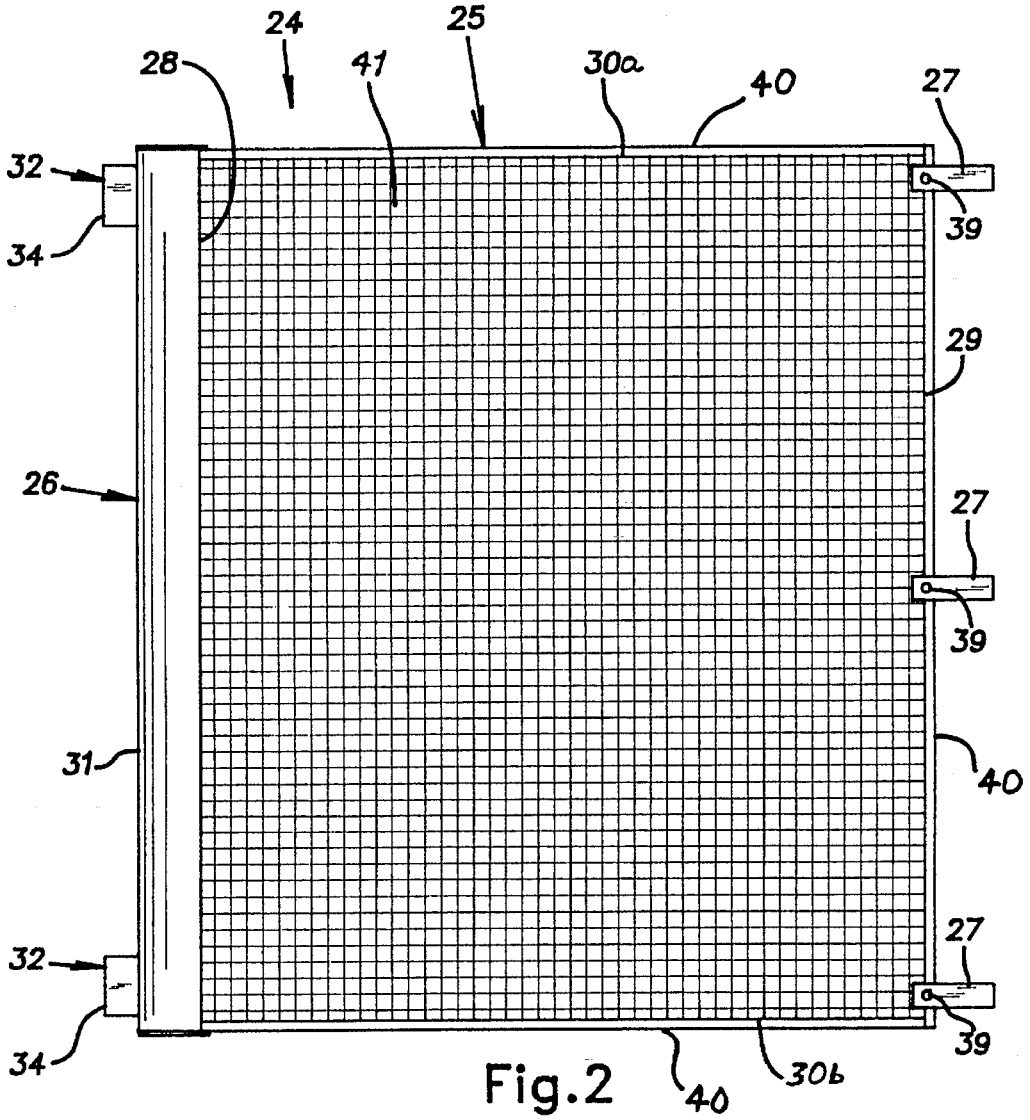
FIG. 2 is a plan view of the retainer.
Figure 3:
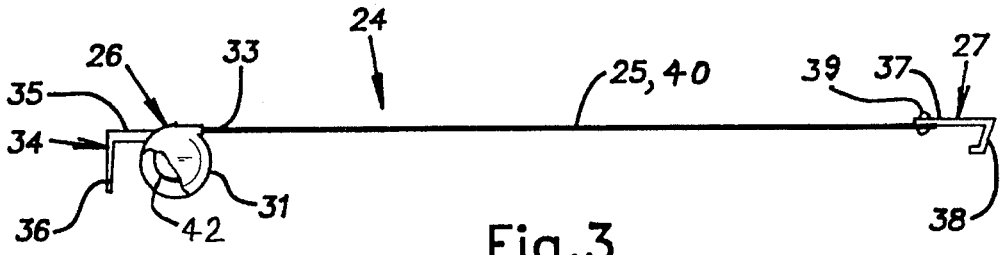
FIG. 3 is an elevational view of the retainer of FIG. 2.

As shown in FIG. 1, soiled articles 17 including light weight articles 17 such as plastic cups are positioned within the upper rack 15. The articles 17 are placed in the upper rack 15 in an upside down position for cleaning by the upwardly projecting washing liquid. A plasticware retainer 24, overlies the articles 17 to hold or retain the articles 17 in the upper rack 15 against the upwardly projecting washing liquid. As best shown in FIGS. 2 and 3, the plasticware retainer 24 comprises a mesh or net member 25, a retractable roller or roller assembly 26, and connectors 27.

As best seen in FIGS. 2 and 3, the net member 25 is a generally planar and rectangularly-shaped sheet of mesh or netting. The net member 25 has first and second ends 28, 29 with a length preferably slightly less than the length of the front 19 and back 20 of the dishwasher upper rack 15. Sides 30*a*, 30*b* of the net member 25 have a length preferably equal to or greater than the length the sides 21, 22 of the dishwasher upper rack 15. The net member 25 has apertures or openings 30 throughout substantially the entire area of the rectangularly-shaped net member 25. As best seen in FIG. 2, the openings 41 of the preferred embodiment are rectangularly shaped. The openings 41 must be of sufficient size so that water, but not the soiled articles 17, may freely flow through the retainer 24 during washing and rinsing cycles of the dishwasher 10.

Preferably, the net member 25 is made of a plastic material or netting such as nylon netting. The net member 25 preferably has sufficient qualities related to corrosion resistance to withstand repeated use in a washing liquid and to high temperature resistance to withstand temperatures in the dishwasher 10 which can reach approximately 140 degrees fahrenheit. The net member 25 must have enough flexibility so that it can be rolled and unrolled onto the roller 42 of the roller assembly 25 in a window shade fashion. The net member 25 is also semi-rigid and/or inelastic so that it is extendable generally above the dishwasher upper rack 15 without support between the ends 28 and 29 to cover the upper rack 15 and retain the articles 17 within the upper rack 15. The net member 25 acts as a lid or cover for the upper rack 15. The net member 25 may comprise other materials having sufficient qualities relating to corrosion resistance, heat resistance, strength, flexibility, and rigidity.

The net member 25 preferably has a border strip 40 that extends about the perimeter of the net at the second end 29 and sides 30*a*, 30*b* of the net member 25. The border strip 40 preferably is a material that adds rigidity to the net member 25. The border strip of the preferred embodiment is vinyl and sewn to the net member 25. The border strip 40 preferably overlaps the edges of the net member 25. The border strip 40 adds rigidity to the net member 25, prevents sharp edges of the net from being exposed, and prevents the net member from tearing or unravelling.

The roller assembly 26 includes a tube or cylinder 31, and mounting means 32. Within the cylinder 31 is a roller 42 having a spring mechanism for winding the net member 25 onto the roller 42. The roller spring mechanism is of any suitable design known in the art, such as the type commonly employed with window shades and the like. It will be noted that the roller 42 could alternatively have manual means for winding such as for example a crank. The first end 28 of the net member 25 is attached to the roller 42. The cylinder 31 includes a slotted opening 33 extending in the axial direction so that the net member 25 can be extended and retracted between a retracted position (not shown) on the roller mechanism and an extended position (shown in FIGS. 1–4) above the dishwasher upper rack 15. The cylinder 31 preferably has a length slightly greater than the length of the net member first end 28 and less than the length of the upper rack front and back 19, 20. The cylinder 31 has a diameter adequate for containing the roller 42 with the net member 25 retracted thereon.

The mounting means 32 removably attaches or connects the roller assembly 26 to the dishwasher upper rack 15. The preferred mounting means 32 includes two flanges 34 integral with the roller assembly cylinder 31. The flanges 34 are located at opposite ends of the cylinder 31 and include an upper portion 35 and a side portion 36. The upper portion 35 extends generally horizontally from the cylinder 31 on a side opposite the slotted opening 33. The side portion 36 extends downwardly from the outer end of the upper portion 35. It will be noted that flanges of other geometries or quantities could be utilized, however, the flanges of the preferred embodiment minimize the potential for interference with various upper rack 15 configurations. It will also be noted that other mounting means 32 such as, for example, straps, hooks, latches, clips, or retainers could be utilized.

The cylinder 31 and flanges 34 can be of any suitable material such as galvanized metal. However preferably as many of the components of the roller assembly 26 as practical are made of plastic material such as polypropylene. When molded of plastic material, the flanges can be integrally molded with the cylinder 31. However, it will be noted that the components of the roller assembly 26 may include other materials having sufficient qualities relating to corrosion resistance, heat resistance, strength, and rigidity, such as, for example stainless steel springs.

The connectors 27 removably attach or connect the second end 29 of the net member 25 to the dishwasher upper rack 15 to retain the net member 25 in the extended position. The connectors 27 of the preferred embodiment include a connecting portion 37 and a hook portion 38 as best seen in FIG. 3. At least a portion of the connecting portion 37 is substantially parallel to and overlaps the net portion 25 and border strip 40 adjacent the second end 29 wherein the connecting portion 37 is fastened to the net portion 25. The connectors 27 are preferably a plastic material such as polypropylene and fastened to the net member 25 by rivets 39. The rivets 39 extend through the connecting portion 37 and the border strip 40. It will be noted that the connectors 27 can be fastened to the net member 25 by other fastening means known in the art. The hook portion 38 of the connector 27 extends downwardly and inwardly from an outer end of the connecting portion 37 and is adapted for hooking a horizontal segment of the upper rack 15. It will be noted that other embodiments of the connectors could be utilized such as for example spring clips, swiveled hooks, straps, and snaps.

Preferably, three connectors 27 are fastened adjacent to the second end 28 of the net member 25, with one connector 27 generally adjacent each side 29, 30 of the net member 25 and one generally spaced equally therebetween. It will be noted, however that other quantities of connectors could be utilized. The connectors 27 are preferably made of plastic, however, the connectors 27 may comprise other materials having sufficient qualities relating to corrosion resistance, heat resistance, and strength.

As best seen in FIG. 1, the soiled articles 17 are placed in the dishwasher racks 15, 16. When the articles 17 are loaded, if the retainer 24 is not already attached to the upper rack 15, the retainer 24 is taken from storage. The roller assembly 26 of the retainer 24 is positioned along and parallel to the inside of the back 20 of the upper rack 15 such that a horizontal wire segment of the upper rack back 20 is within the flanges 34 of the roller assembly 26. The retainer 24 is released and the flanges 34 attach the retainer 24 to the upper rack 15. The second end 29 of the net portion 25 is grasped and pulled such that the net portion 25 extends from the retracted position in which it was stored in the roller assembly 26 to an extended position over the upper rack 15. Once the net portion extends to the upper rack front 19, the connectors 27 are placed about a horizontal wire segment of the upper rack front 19. In this position (FIG. 3), the hook portion 38 of the connectors 27 engage the horizontal wire segment of the upper rack front 19 to connect the second end 29 of the net portion 25 to the upper rack 15. The retainer 24 is preferably of such size and shape to cover substantially the entire dishwasher upper rack 15. The retainer 24 closes off the top of the upper rack 15 so that the net member 25 is generally above the articles located in the upper rack 15. When installed the net member 25 remains generally planar and generally closes off the top of the upper rack 15 in a lid or cover like manner. The racks 15, 16 are pushed into the cleaning chamber 12, the door 14 is closed, and the washing cycle is initiated.

During the washing cycle the retainer 24 has sufficient weight and rigidity to retain the articles 17 in the upper rack 15 against the upwardly projecting washing liquid and prevent them from dislodging. After the washing cycle is completed, the door 14 is opened, and the upper rack 15 is pulled out. After removing the connectors 27 from the upper rack front 19, the net member 25 is pulled outwardly slightly to initiate the roller assembly 26 and roll the net member 25 onto the roller assembly 26 in a window shade fashion. The clean articles can be unloaded when the net member is in the retracted position. Once the articles are removed, the retainer 24 can remain attached to the upper rack 15 until it is again required or it can be removed for storage by simply lifting upwardly to remove the flanges 34 from the horizontal wire segment of the upper rack back 20. When desired, the retainer 24 can be reinstalled in the above described manner.

Figure 4:
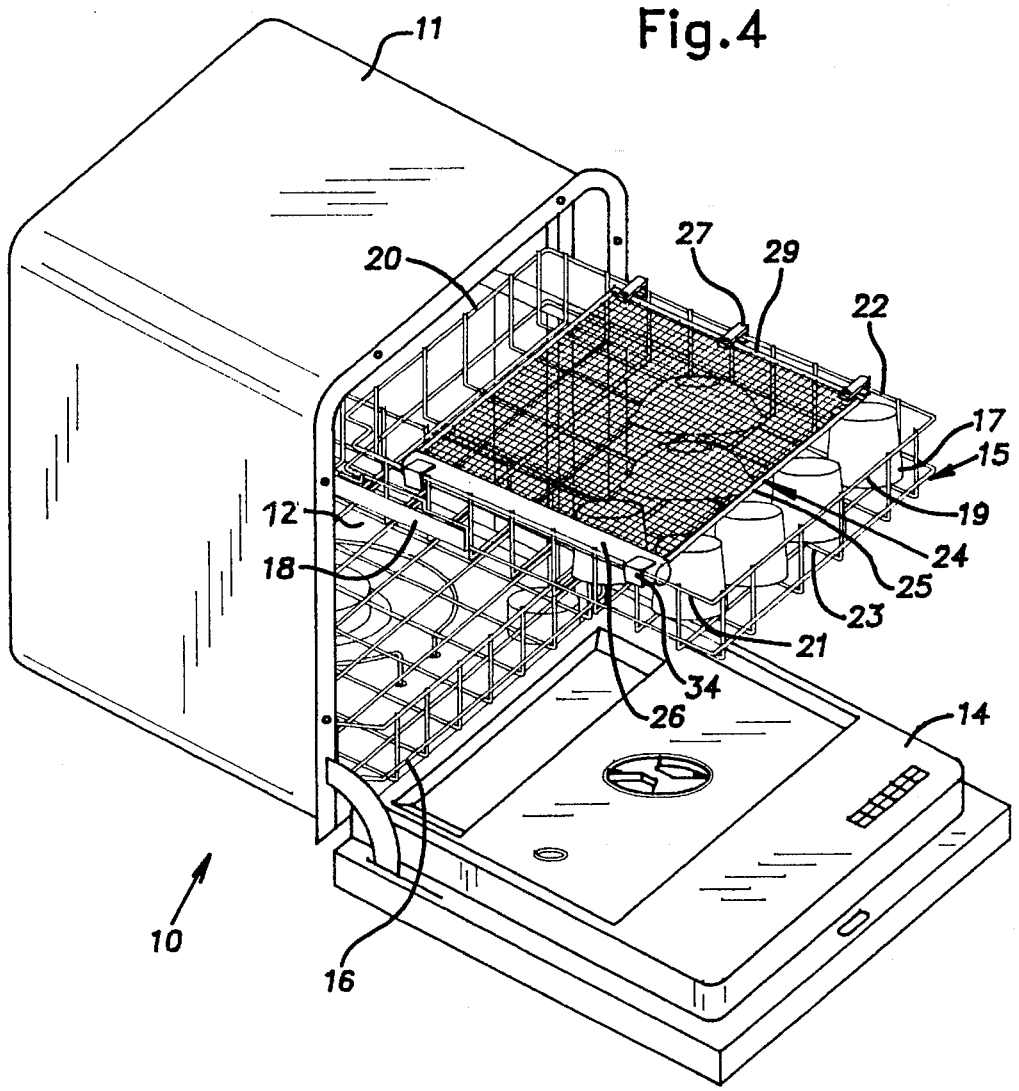
FIG. 4 is a perspective view of a dishwasher with a retainer according to the present invention installed in the upper rack perpendicular to the position of the retainer of FIG. 1.

Because of the size and shape of the retainer 24, it is not necessary to orient the retainer 24 in the above described direction. The retainer 24 can also be installed such that the roller assembly 26 is parallel to the upper rack sides 21, 22 as shown in FIG. 4. This versatility in mounting allows the retainer 24 to be quickly installed with a minimum of attention to orientation. In addition, this allows the articles 17 to be placed in the upper rack 15 without regard to location.

Although a particular embodiment of a retainer for holding lightweight articles in a dishwasher has been described in detail, it will be understood that the invention is not limited correspondingly in scope, but includes all changes and modifications coming within the spirit and terms of the claims appended hereto.

What is claimed is:

1. A retainer for holding lightweight articles in a dishwasher rack against a force of upwardly projecting liquid, said retainer comprising:

a roller assembly removably mountable to said dishwasher rack;

a semi-rigid generally rectangularly-shaped net member having first and second ends, said first end of said net member attached to said roller assembly, whereby said net member is rollable on said roller assembly;

a border strip attached to said net member along said second end of said net member; and connectors for removably attaching said second end of said net member to said dishwasher rack, said connectors being attached to said net member by a fastener extending through said connector and said border strip, wherein said net member is extendable over at least a portion of said dishwasher rack to retain said lightweight articles in said dishwasher rack during washing.

2. The retainer according to claim 1, wherein said connectors are adapted for hooking a horizontal segment of said rack.

3. The retainer according to claim 1, wherein said roller assembly has a plastic cylinder generally surrounding a roller and roller mounting means integrally molded with said cylinder.

4. The retainer according to claim 3, wherein said roller mounting means is a pair of flanges extending outwardly and downwardly from the side of said cylinder.

5. The retainer according to claim 4, wherein one flange of said pair of flanges is located adjacent each end of said cylinder.

6. The retainer according to claim 1, wherein said net member has a border strip along each side of said net member.

7. The retainer according to claim 1, wherein said connectors are hook-shaped each having a connecting portion and a hook portion.

8. The retainer according to claim 7, wherein said connecting portion overlaps said border strip at said second end of said net member and said fastener extends through said connecting portion and said border strip.

9. The retainer according to claim 1, wherein said net member comprises nylon netting.

10. The retainer according to claim 1, wherein said fastener is a rivet.

11. The retainer according to claim 1, wherein said border strip is vinyl sewn to said net member.

12. The retainer according to claim 1, wherein said border strip overlaps edges of said net member.

13. The retainer according to claim 1, wherein said border strip is inelastic effective for adding rigidity to said net member.

14. The retainer according to claim 1, wherein said net member is inelastic.

* * * * *